US012569739B2

(12) United States Patent
Dushane et al.

(10) Patent No.: US 12,569,739 B2
(45) Date of Patent: Mar. 10, 2026

(54) BASEBALL PITCHER TRAINING METHOD AND DEVICE

(71) Applicants: Joseph Dushane, Fort Myers, FL (US); Mark Dushane, Orange Park, FL (US)

(72) Inventors: Joseph Dushane, Fort Myers, FL (US); Mark Dushane, Orange Park, FL (US)

( * ) Notice: Subject to any disclaimer, the term of this patent is extended or adjusted under 35 U.S.C. 154(b) by 0 days.

(21) Appl. No.: 18/526,388

(22) Filed: Dec. 1, 2023

(65) Prior Publication Data

US 2024/0181315 A1 Jun. 6, 2024

Related U.S. Application Data

(60) Provisional application No. 63/429,446, filed on Dec. 1, 2022.

(51) Int. Cl.
*A63B 69/00* (2006.01)

(52) U.S. Cl.
CPC .. *A63B 69/0002* (2013.01); *A63B 2069/0006* (2013.01); *A63B 2214/00* (2020.08)

(58) Field of Classification Search
CPC ..... A63B 69/0002; A63B 2069/0006; A63B 2214/00; A63B 43/002; A63B 43/008
USPC ..... D21/707
See application file for complete search history.

(56) References Cited

U.S. PATENT DOCUMENTS 2,925,273 A * 2/1960 Pratt ..... A63B 69/0002 434/247
3,110,494 A * 11/1963 Morgan ..... A63B 69/0002 473/458
5,067,719 A * 11/1991 Mook ..... A63B 69/3655 473/200
5,588,648 A * 12/1996 Stebbins ..... A63B 37/02 473/600
6,592,477 B1 * 7/2003 Yang ..... A63B 37/14 473/597
6,634,970 B2 * 10/2003 Jiminez ..... A63B 41/08 473/597
D546,911 S * 7/2007 Kirschbaum ..... D21/713
7,470,203 B1 * 12/2008 Stillinger ..... A63B 37/12 473/574
8,152,664 B2 * 4/2012 Madore ..... A63B 41/08 473/603
8,439,774 B2 5/2013 Massey
8,512,170 B2 8/2013 Muscarello
8,684,868 B2 4/2014 Fountain, III
(Continued)

*Primary Examiner* — Steven B Wong
(74) *Attorney, Agent, or Firm* — Steven M. McHugh; Halloran & Sage LLP

(57) ABSTRACT

A training device includes a device body having a body circumference, a body length and a body diameter. The device body is cylindrical in shape and includes a body side and body first and second ends. The training device includes side strips each having a strip width extending along the body circumference and a strip length extending along the body length, wherein each side strip extends along the body length and are equally space apart along the body circumference, wherein the side strips include two opposing side strips having three ribs extending out of a strip surface to extend across the strip width and to be equally spaced along the strip surface. The training device includes end strips which extend across the body diameter on the body first and second ends to connect opposing side strips and form a cross shaped pattern on the body first and second ends.

19 Claims, 5 Drawing Sheets

(56) References Cited

U.S. PATENT DOCUMENTS

| | | | | |
|---|---|---|---|---|
| 8,708,843 | B1 | 4/2014 | Sekac et al. | |
| 9,149,698 | B2 | 10/2015 | Spiegler | |
| 10,561,915 | B1 | 2/2020 | Mcguiness et al. | |
| D1,006,164 | S * | 11/2023 | Warner | D21/780 |
| 2003/0162603 | A1* | 8/2003 | Breaker | A63B 43/002 473/569 |
| 2009/0042659 | A1* | 2/2009 | Breaker | A63B 67/14 473/409 |
| 2014/0066238 | A1* | 3/2014 | Smith | A63B 69/0002 473/597 |
| 2014/0094328 | A1* | 4/2014 | Shearer | A63B 69/0002 473/451 |
| 2015/0157912 | A1* | 6/2015 | Guilfoyle | A63B 45/00 29/433 |
| 2015/0314182 | A1* | 11/2015 | Kasdorf | A63B 37/12 473/451 |
| 2018/0345108 | A1 | 12/2018 | Mueller | |
| 2020/0070026 | A1 | 3/2020 | Holman | |
| 2020/0246665 | A1 | 8/2020 | Teperson | |

* cited by examiner

BASEBALL PITCHER TRAINING METHOD AND DEVICE

RELATED APPLICATION

This application is related to and claims the benefit of priority of the filing date of U.S. Provisional Patent Application Ser. No. 63/429,446, filed on Dec. 21, 2022, the contents of which are incorporated herein by reference in its entirety.

TECHNICAL FIELD

The present invention generally relates to a method and device for training baseball pitchers to improve their skills, and more particularly to a method and device for training a baseball pitcher to perform a changeup pitch.

BACKGROUND

In the game of baseball an object of pitching the ball is to throw the ball toward a batter in a way to cause the ball to pass through a predefined area called the "strike zone" which is located above home plate in such a way that the batter misjudges the path of the ball and hits the ball in an ineffective manner or misses hitting the ball altogether. Thus, the pitcher causes the ball to deviate from a nominally linear path and/or changes the speed of the ball from one pitch to the next in an attempt to prevent the batter from 'guessing' what pitch the pitcher is using to throw the ball. There are many different types of pitches that a pitcher can choose to throw, such as a curveball, a slider, a fastball, a knuckleball, a sinker, etc. Each one of these pitches requires the pitcher to hold and throw the ball toward the strike zone in a unique way. Since the pitcher is fully visible when he/she winds up to throw the pitch, a batter typically looks for an indicator (i.e., a 'tell') that may give some indication of what type of pitch the pitcher will be throwing, such as the pitchers stance, arm motion, mannerism, ball grip or some other behavior. Thus, a good pitcher avoids telegraphing a 'tell' to the batter.

As discussed briefly above, each of the baseball pitches typically require the pitcher to hold, or grip, and throw the ball in a unique way. For example, consider the fastball pitch. Generally, a fastball pitch causes the ball to travel in an approximately straight line (i.e., along a nominally straight path in the horizontal plane and with a relatively flat trajectory in the vertical plane) toward the strike zone at a high rate of speed. In order to throw a fastball, the pitcher typically grips the ball such that the fingertips of the pitcher's index finger and middle finger are touching the seams of the baseball. The pitcher then throws the ball toward the target (i.e., strike zone) using an overhand throw and when the pitcher is about to release the ball from his/her grip, the pitcher "pulls" or "yanks" down on the seams of the ball with the tips of his/her index finger and middle finger. This causes the ball to 'shoot' out of the hand of the pitcher in a relatively straight line toward the target.

A "change-up" pitch is a pitch that is typically thrown after a fastball pitch is thrown, or is a pitch that is used to "set up" a fastball pitch, because it resembles a fastball pitch as it has substantially the same arm motion as the fastball pitch. However, in the change-up pitch, a selected manner of gripping the ball is used which causes the velocity of the ball to travel 8 to 12 percent slower than the typical velocity of a fastball pitch thrown by the same skilled pitcher. When a pitcher properly executes a change-up pitch, the batter is unable to perceive or identify any 'tell' that suggests that the forthcoming ball speed will be any different from that of a fastball pitch which was thrown earlier. Thus, the change-up can cause the batter to be thrown off balance and as a result the batter's swinging bat will fail to make contact with the ball or will miss-hit the ball to cause a foul ball or an easily fielded ball to cause an out. There are several different ways of gripping a baseball to throw an effective change-up pitch and these ways can vary depending upon the player's age, physique and hand size which may work best for the individual pitcher.

Unfortunately, teaching a novice baseball pitcher how to throw a change-up pitch requires that the pitcher grip the ball in a certain way, and someone who is just learning may be unable to identify what the 'proper grip' is supposed to be and the subtleties of the finger placement. Additionally, when throwing an actual baseball, it is even more difficult to get meaningful feedback simply by watching the baseball traverse along its path as it flies away from the pitcher toward home plate.

SUMMARY

A training device for training a baseball pitcher how to throw a predetermined pitch, is provided and includes a device body having a body circumference, a body length and a body diameter, wherein the device body is cylindrical in shape and includes a body side, a body first end and a body second end. The training device also includes a plurality of side strips, wherein each of the plurality of side strips includes a strip width which extends along the body circumference and a strip length which extends along the body length, and wherein each of the plurality of side strips extends along the body length between the body first end and the body second end and wherein the each of the plurality of side strips are equally space apart from each other along the body circumference, and wherein the plurality of side strips includes two opposing side strips having three ribs which extend out of a strip surface of the two opposing side strips, and which extend across the strip width, wherein the three ribs are equally spaced along the strip surface. The training device further includes a plurality of end strips, wherein the plurality of end strips extends across the body diameter on the body first end and the body second end to connect opposing side strips and to form a cross shaped pattern on the body first end and the body second end.

A training device for training a baseball pitcher how to throw a predetermined pitch is provided and includes a device body having a body circumference, a body length and a body diameter, wherein the device body is cylindrical in shape and includes a body side, a body first end and a body second end. The training device also includes a plurality of non-ribbed side strips, wherein each of the plurality of non-ribbed side strips includes a strip width which extends along the body circumference and a strip length which extends along the body length, wherein each of the plurality of non-ribbed side strips are disposed to be on opposing sides of the body side. Additionally, the training device includes a plurality of ribbed side strips, wherein each of the plurality of ribbed side strips includes a strip width which extends along the body circumference and a strip length which extends along the body length, and wherein each of the plurality of ribbed side strips extends along the body length, wherein each of the plurality of ribbed side strips are disposed on to be on opposing sides of the body side, and wherein the plurality of ribbed side strips includes three ribs which extend out of a strip surface of the plurality of ribbed side strips, and which extend across the strip width, wherein the three ribs are equally spaced along the strip surface. The training device further includes a plurality of end strips, wherein the plurality of end strips extends across the body diameter on the body first end and the body second end to connect the opposing non-ribbed side strips and the opposing ribbed side strips and to form a cross shaped pattern on the body first end and the body second end.

A method for training a baseball pitcher to throw a predetermined pitch using a training device is provided, wherein the training device includes a cylindrically shaped device body having a plurality of ribbed side strips, a plurality of non-ribbed side strips and a plurality of end strips, wherein the plurality of ribbed side strips and the plurality of non-ribbed side strips are equally spaced along a circumference of the device body, wherein the plurality of non-ribbed side strips are disposed on opposing sides of the device body, and wherein the plurality of ribbed side strips are disposed on opposing sides of the device body and includes three ribs extending from a surface of the ribbed side strip, wherein the three ribs are space apart from each other by about 0.75 inches to form two enclosed spaces between the three ribs, and wherein the plurality of end strips are disposed on end portions of the device body to form a cross shape and connect the plurality of ribbed side strips and to connect the plurality of non-ribbed side strips. The method includes gripping the training device with a pitcher hand, such that a middle finger is located on one of the two ribbed strips to be within one of the two enclosed spaces, a ring finger is located within the other of the two enclosed spaces, a pinky finger is located on one of the end portions of the device body, an index finger is located on the other of the end portions of the device body and a thumb is located on the other of the two ribbed strips, pitching the training device away from the pitcher, observing at least one motion characteristic of the training device as the training device travels through space and adjusting the gripping the training device responsive to the at least one motion characteristic of the training device.

Additional technical features and benefits are realized through the techniques of the present invention. Embodiments and aspects of the invention are described in detail herein and are considered a part of the claimed subject matter. For a better understanding, refer to the detailed description and/or to the drawings.

BRIEF DESCRIPTION OF THE DRAWINGS

The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings in which:

DETAILED DESCRIPTION

Figure 1:
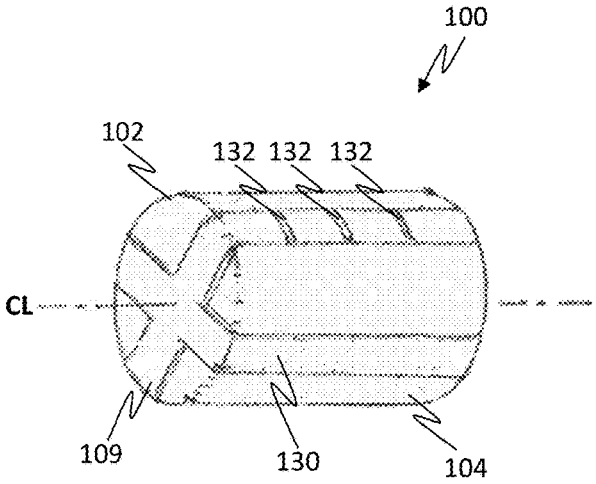
FIG. 1 is a side, perspective view of a training device, in accordance with an embodiment.
Figure 4:
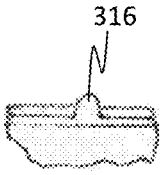
FIG. 4 is an enlarged view of a side portion of the training device of FIG. 1, in accordance with an embodiment.
Figure 2:
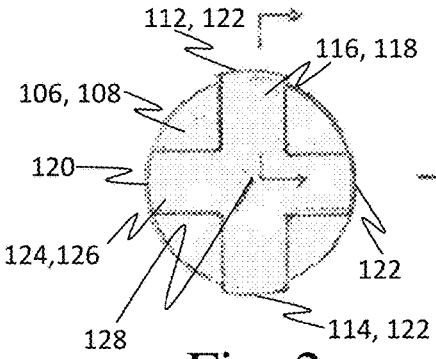
FIG. 2 is an end view of the training device of FIG. 1, in accordance with an embodiment.
Figure 3:
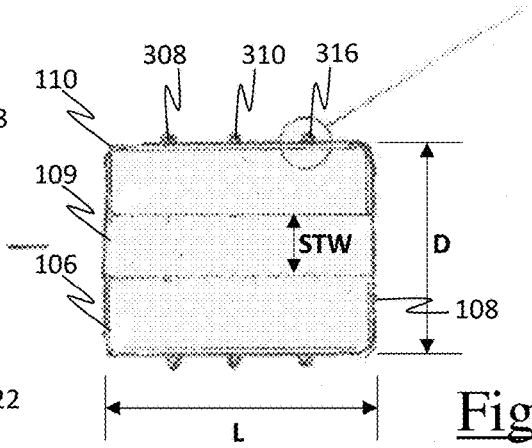
FIG. 3 is a side view of the training device of FIG. 1, in accordance with an embodiment.
Figure 5:
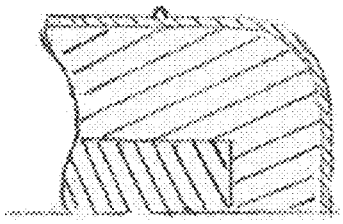
FIG. 5 is an enlarged sectional view of a side, corner portion of the training device of FIG. 1, in accordance with an embodiment.
Figure 6:
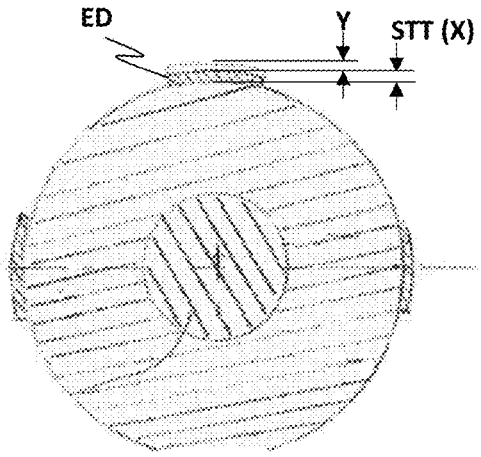
FIG. 6 is a sectional end view of the training device of FIG. 1, in accordance with an embodiment.

As discussed briefly above, the present invention relates to a training device for training a baseball pitcher, and more particularly to a training device for training a baseball pitcher on how to throw a changeup pitch.

Referring to the FIGs, a training device 100 for training a baseball pitcher how to throw a changeup pitch is shown, in accordance with an embodiment. The training device 100 includes a cylindrical shaped device body 102 having a body length L, a body diameter D and a central lengthwise axis CL. Device body 102 includes a body side 104 which transitions into a body first end 106 and a body second end 108 via a rounded and/or beveled transition surface 110. Although the body side 104 is shown herein as terminating at the body first end 106 and the body second end 108 via a rounded and/or beveled transition surface 110, it is contemplated that in other embodiments, the body side 104 may terminate at the body first end 106 and the body second end 108 via a non-rounded (e.g., about 90° angle) surface.

The training device includes a plurality of strips 109. The plurality of strips 109 includes a first side strip 112, a second side strip 114, a first end strip 116 and a second end strip 118. The first side strip 112 and the second side strip 114 are disposed on opposing sides of the body side 104 and extend in a lengthwise direction along the length of the body side 104 between the body first end 106 and the body second end 108. The first end strip 116 extends across the body first end 106 to connect the first side strip 112 and the second side strip 114 on the body first end 106. Similarly, the second end strip 118 extends across the body second end 108 to connect the first side strip 112 and the second side strip 114 on the body second end 108.

The plurality of side strips 109 further includes a third side strip 120, a fourth side strip 122, a third end strip 124 and a fourth end strip 126. The third side strip 120 and the fourth side strip 122 are disposed on opposing sides of the body side 104 and extend in a lengthwise direction along the length of the body side 104 between the body first end 106 and the body second end 108. The third end strip 124 extends across the body first end 106 to connect the third side strip 120 and the fourth side strip 122 on the body first end 106. Similarly, the fourth end strip 126 extends across the body second end 108 to connect the third side strip 120 and the fourth side strip 122 on the body second end 108. It should be appreciated that the first side strip 116, the second side strip 118, the third side strip 120 and the fourth side strip 122 are arranged to extend parallel to the central lengthwise axis CL and to be equally spaced apart around the circumference of the device body 102 to diametrically oppose each other. Moreover, the first end strip 116 and the third end strip 124 are arranged to extend across the body diameter D and through the axis CL of the body first end 106 to form a cross shaped pattern 128 on the body first end 106. Similarly, the second end strip 118 and the fourth end strip 126 are arranged to extend across the body diameter D and through the axis CL of the body second end 108 to form a cross shaped pattern 128 on the body second end 108.

It should be appreciated that each of the plurality of strips 109 includes a strip thickness STT such that the plurality of strips 109 are raised from the surface of the device body 102 by a distance X to allow a user to identify the edge ED of the plurality of strips 109 using their fingers. Moreover, each of the plurality of strips 109 includes a strip width STW and a strip surface 130 having a surface texture that differs from the surface of the device body 102. For example, in one embodiment, the surface texture of the strip surface 130 may feel rougher to the touch than the surface of the device body 102. In addition, in an embodiment, two opposing strips 122 of the plurality of strips 109 may include a plurality of ribs 132 (e.g., three ribs) which at least partially traverse the width STW of the opposing strips 122 and which are disposed and spaced apart from each other along the lengthwise direction of the opposing strips 122. The plurality of ribs 132 extends outwardly from the strip surface 130 by a distance Y to allow a user to identify the ribs 132 using their fingers. The remaining strips of the plurality of strips 109 may not include ribs. Moreover, it is contemplated that the color of the surface of the device body 102 contrasts with the color of the plurality of strips 109. For example, device body 102 may have a white or black color and the plurality of strips 109 may have red, green, yellow, blue, etc. It is also contemplated that each of the plurality of strips 109 may have different colors from each other. It is further contemplated that the device body 102 and/or the plurality of strips 109 may have a color that indicates the weight of the training device 100 and/or some other property, such as the specific gravity, length L, etc.

In accordance with one embodiment, the training device 100 may have a weight of about 5 ounces and the device body 102 may have a length L of about three inches and a diameter D of about three inches, where the diameter D approximates the three inch diameter of a standard baseball. In an embodiment the training device 100 may have a weight range of about 3.5 oz to about 10 oz to allow the training device 100 to be used for "underload" training. The use of a lighter version of the training device 100 allows a pitcher to achieve a greater arm speed. Additionally, although the device body 102 is disclosed herein as being constructed from a material (or combination of materials) having a specific gravity of about 1.13 (e.g., Elastosil® rubber), it is contemplated that in other embodiments, the device body 102 may be constructed from any material (or combination of materials) having any specific gravity suitable to the desired end purpose. Device body 102 may define an internal device body cavity 134 for containing a weighted structure which allows the training device 100 to have different weights for various users. Although the strip thickness STT for each of the plurality of strips 109 is discussed herein as being sufficient enough such that each of the plurality of strips 109 are from the surface of the device body 102 by a distance X of about 0.030 inches, any strip thickness STT suitable to the desired end purpose may be used as long as the edge ED of the plurality of strips 109 is perceivable by the fingers of the user.

Moreover, although each of the plurality of strips 109 are disclosed as having a strip width STW of about 0.75 inches (which is about 8 percent of the about 9.9 inch circumference of an about 2.9 inch diameter body), any strip width STW may be used suitable to the desired end purpose. Additionally, as discussed briefly hereinabove, the surface texture or finish of the strip surface 130 of the plurality of strips 109 may be rougher than the texture or finish of the strip free surface of the device body 102. For example, in an embodiment, the strip free surface of device body 102 may have a surface roughness of about 32-63 microinch per inch RMS as compared to a strip surface 130 having a surface roughness of about 500-1000 microinch per inch RMS. Additionally, strip surface 130 may have surface finish (i.e., a surface feature that creates roughness) that is parallel to the lengthwise axis CL. In another embodiment, the strip surface 130 may have other texturing, such as a wave pattern. It should be appreciated that the roughness feature of the strip surface 130 may be selected to evoke in the pitcher a feeling that is similar to that which is obtained by grasping the upstanding stitches of a standard baseball.

Additionally, the two opposing strips 122 which include a plurality of ribs 132 (e.g., three ribs) are located on the strip surface 130 to guide the pitcher on where to place the ring finger (fourth digit from thumb) and the middle finger (third digit from thumb) on the exterior of the training device 100 when the pitcher grasps the training device 100. For example, in an embodiment, when the pitcher grasps the training device 100, the middle phalanges bone of the ring finger should be located between one end rib and the middle rib of the plurality of ribs 132 and the middle phalanges bone of the middle finger should be located between the other end rib and the middle rib of the plurality of ribs 132. In an embodiment, each of the plurality of ribs 132 may extend outwardly from the strip surface 130 by a distance Y of about 0.03 inch and each of the plurality of ribs 132 may be spaced apart from an adjacent rib 132 by about 0.75 inches. In other embodiments, the distance Y of the plurality of ribs 132 and/or the spacing distance between adjacent ribs 132 may be distance as desired suitable to the desired end purpose. It should be appreciated that the strips 109 that are circumferentially located between the two opposing ribbed strips 122 do not include strips and are "plain", since in pitches taught by the use of the device there should not be a tactile suggestion to contact a trip adjacent to the two opposing ribbed strips 122. Moreover, there are no ribs located on the end strips 116, 118, 124, 126.

Device body 102 may be modular and may include a body first portion 200 and a body second portion 202 securely connects together, such as via a snap-fit type of connector. Each of the body first portion 200 and the body second portion 202 define a portion of a device body cavity 204, wherein when the body first portion 200 and the body second portion 202 are securely connected, the device body cavity 204 is configured to securely and non-movably contain a weight insert 206 to allow the weight of the training device 100 to be adjustable.

In one embodiment, the training device 100 has a weight of about five (5) ounces. If device body 102 is constructed from a material having a specific gravity of 1.13 gm/cc, a weight insert 206 may not be needed within the device body cavity 204. In this case, device cavity 204 may be left empty. However, if a user wishes to increase the weight of the training device 100, the user may dispose a weight insert 206 having a desired weight into the device cavity 204. In this way, the weight of the training device 100 may be variable depending upon the pitcher that is using the training device 100. For example, a 5 ounce weight insert 206 may be used to simulate the weight of a common baseball. For training purposes, a weight insert 206 of about 8 ounces may be useful for a pitcher who is 13 years old and younger, while a weight insert 206 of about 10 ounces may be useful for a pitcher who is 13 years old and older. Moreover, for training younger pitchers, a training device 100 may be configured to contain no weight insert 206.

It should be appreciated that a training device 100 having a low density outer portion (e.g., device body 102) and a high density inner portion (e.g., weight insert 206) imparts desirable dynamic behavior to the training device 100, which favorably compares to a standard baseball which weighs about 5 ounces, has a rubber coated corked center, a lower density (specific gravity) spherical wool yarn winding surrounding the center and a stitched cowhide exterior.

Figure 7:
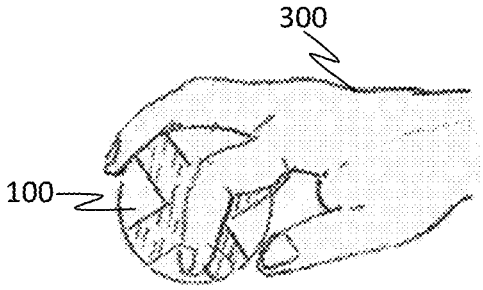
FIG. 7 shows an end view of the training device of FIG. 1 being gripped by the hand and fingers of a user, in accordance with an embodiment.
Figure 8:
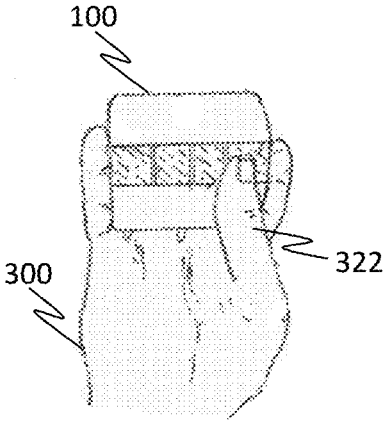
FIG. 8 shows a side view of the training device of FIG. 1 being gripped by the hand and fingers of a user, in accordance with an embodiment.
Figure 9:
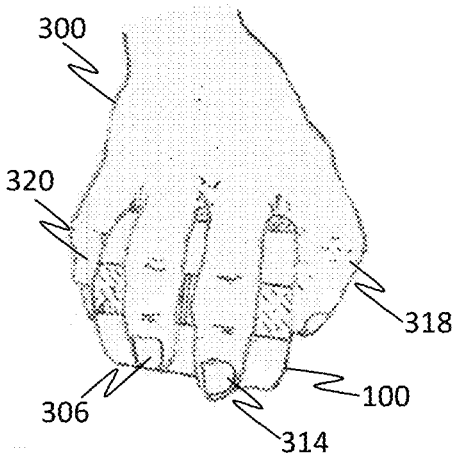
FIG. 9 shows a side view of the training device of FIG. 1 being gripped by the hand and fingers of a user, in accordance with an embodiment.
Figure 11:
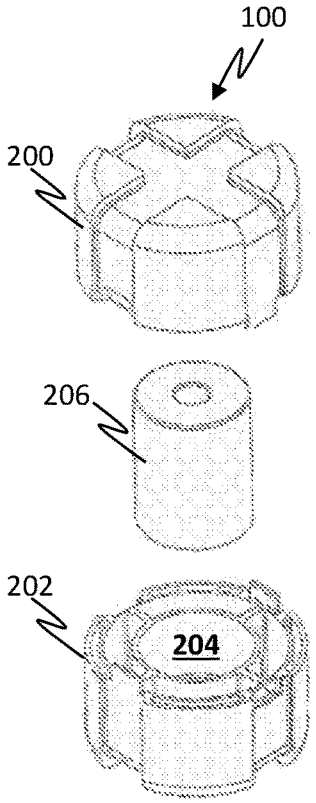
FIG. 11 shows an exploded view of the cylinder portion of the training device of FIG. 1, according to an embodiment.
Figure 10:
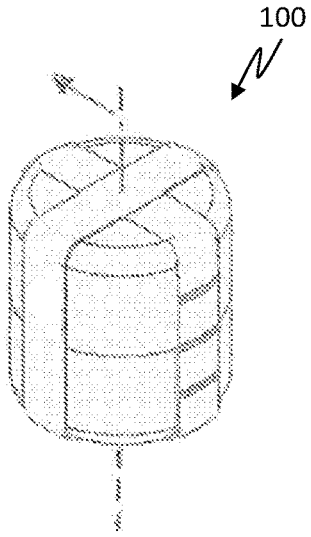
FIG. 10 shows an isometric view of the training device of FIG. 1, according to an embodiment.
Figure 12:
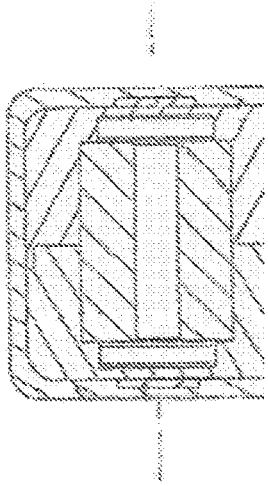
FIG. 12 shows a sectional side view of the cylinder portion of the training device of FIG. 1, according to an embodiment.
Figure 13:
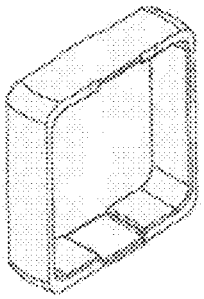
FIG. 13 shows a perspective view of the top strip portion of the training device of FIG. 1, according to an embodiment.
Figure 14:
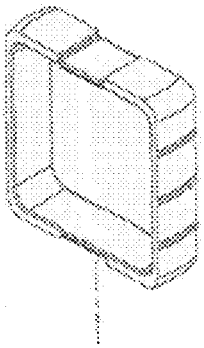
FIG. 14 shows a perspective view of the bottom strip portion of the training device of FIG. 1, according to an embodiment.
Figure 15:
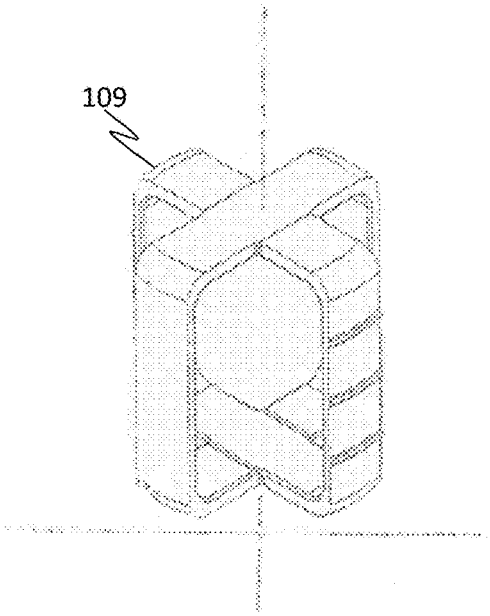
FIG. 15 shows a perspective view of the top and bottom strip portions of the training device of FIG. 1 assembled together, according to an embodiment.
Figure 16:
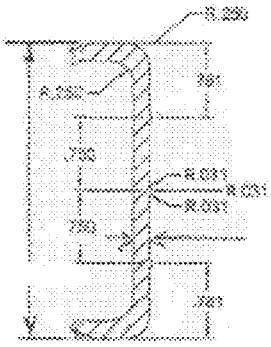
FIG. 16 shows a sectional side view of the bottom strip portion of the training device of FIG. 1, according to an embodiment.
Figure 17:
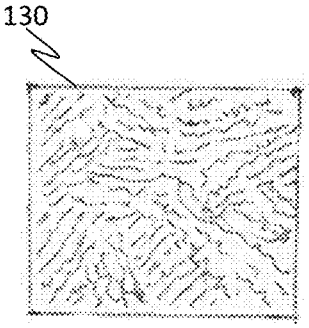
FIG. 17 shows a top down view of the strip of the training device of FIG. 1 showing the contoured surface of the strip, according to an embodiment.

It should be appreciated that the training device 100 may be gripped in various ways in order to train a pitcher to throw various types of pitches. In an embodiment and referring to FIG. 7, FIG. 8 and FIG. 9, when the pitcher's hand 300 is gripping the training device 100 for training a pitcher to throw a change-up pitch, the placement of the pitcher's fingers 302 is shown. In this case, when the pitcher grasps the training device 100, the ring finger 306 should be associated with one of the opposing strips 122 located between one end rib 308 and the middle rib 310 of the plurality of ribs 132 and the middle finger 314 should be located between the other end rib 316 and the middle rib 310 of the plurality of ribs 132. The index finger (second digit from thumb) 318 and the pinky finger (fifth digit from thumb) 320 should be located on the opposing body ends 106, 108, where each of the index finger 318 and the pinky finger 320 lay along a portion of an end strip 116, 118, 124, 126. The pitcher's thumb 322 is disposed to be resting on the other opposing strip 122. In an embodiment, when the pitcher is the gripping the training device 100 prior to being thrown, the pitcher's thumb 322 and index finger 318 may form a circle on one of the body ends 106, 108 (similar to that of an 'ok' hand sign).

When the pitcher grips the training device 100 as described hereinabove and throws the training device, the plurality of strips 109 of the training device 100, being highly contrasting in color from the unstriped portion of the device body 102, enable the pitcher (e.g., the thrower), a coach and/or another viewer to observe and discern how the training device 100 moves through space, i.e., the degree and rate of rotation and/or wobble etc., of the training device 100. This observation allows the pitcher to adjust his/her grip on the training device 100 until the pitcher achieves the desired result. In an embodiment, when using the training device 100, the pitcher may grip the training device 100 as described above such that the thumb 322 and the index finger 318 of the pitcher substantially forms an 'ok circle' symbol on one of the body ends 106, 108 of the training device 100. The 'ok circle' symbol may be open (e.g., the thumb 322 and the index finger 318 don't touch) or the 'ok symbol' may be closed (e.g., the thumb 322 and the index finger 318 don't touch).

Figure 18:
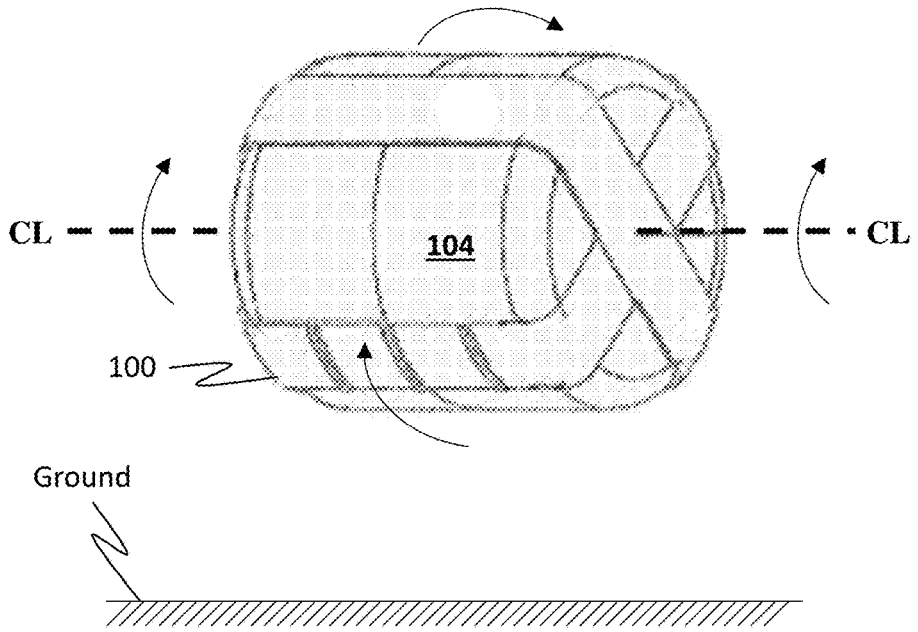
FIG. 18 shows a side view of the training device rotating about the axis CL after being thrown without pronation, according to an embodiment.
Figure 19:
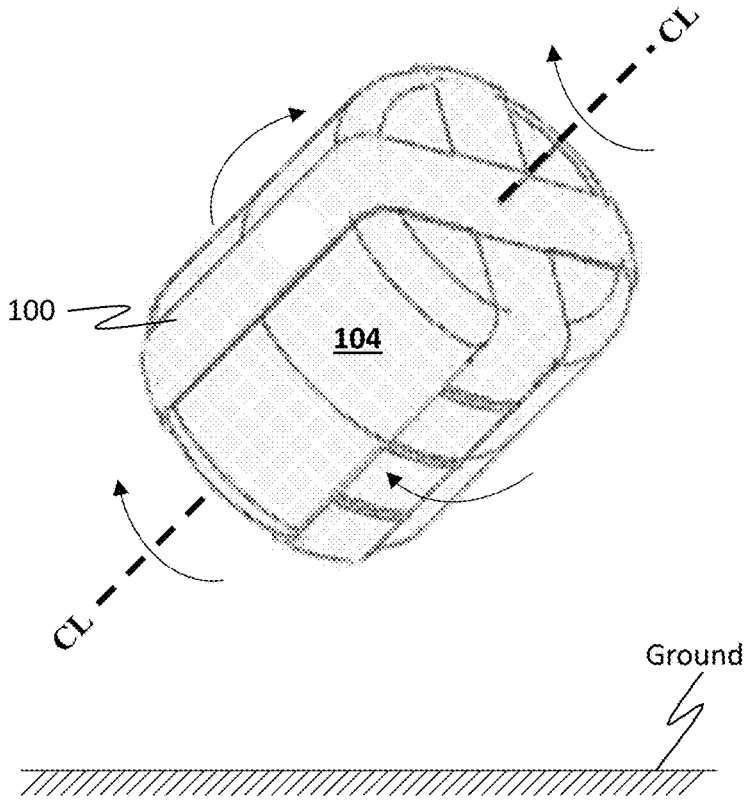
FIG. 19 shows a side view of the training device rotating about axis CL after being thrown with pronation, according to an embodiment.

As the pitcher throws the training device 100 (i.e., pitches the training device 100), the training device 100 leaves the pitcher's hand and moves through the air toward a target. Referring to FIG. 18, if the pitcher throws the training device 100 without any pronation, the training device 100 should move through the air toward the target with a 'flat spin,' meaning that the training device 100 should be oriented such that the body side 104 (i.e., axis CL) is substantially horizontal (i.e., parallel to the ground) and such that the training device 100 is rotating about the axis CL. In an embodiment, the pitcher may train with the training device 100 until this result is achieved. During training, as the pitcher throws the training device 100, the pitcher may apply pronation to the pitch to achieve a more effective 'change-up' pitch. Referring to FIG. 19, when the pitcher applies pronation to the pitch, the training device 100 will move through the air at an angle that is not substantially horizontal, but rather the body side (i.e., axis CL) 104 is tilted at and rotating about an angle other than horizontal or vertical.

In accordance with an embodiment, the training device 100 is configured and used to teach a baseball player how to throw a changeup pitch in baseball. The training device 100 is also designed to help a baseball player to 'stay behind' the baseball longer as it is being pitched/thrown and to reinforce the wrist flexion, pronation and to activate the forearm muscles to relieve stress off of the elbow. In an embodiment, the training device 100 should result in about an 8% to about a 12% less difference in speed from that of the speed of a fastball throw. This is advantageous because this difference provides a very affective deception by throwing an off balance pitch to a batter. The training device 100 provides instant visual feedback by observing the motion of the stripes and how the training device 100 leaves the hand. Upon leaving the hand of a thrower, the training device 100 and thus, the strips 109, will spin about axis CL and the training device 100 may stay flat as its thrown. This reinforces 'staying behind the ball' vs a football like throw which is 'supinated'. This also reinforces wrist flexion which is a final phase of the kinetic chain in throwing/pitching. The training device 100 helps a thrower get a 'FEEL' of the training device 100 as the training device 100 comes out of the hand. The training device 100 also helps a player understand pronating the hand (i.e., how much to pronate and how much not to pronate).

It should be appreciated that 'staying behind the ball' also helps regular position baseball players to stay behind the ball to help with the ball velocities and accuracy. Conversely, being 'outside the ball' while throwing (or supinating) creates inaccurate throws and may cause arm injury to the thrower. When throwing the training device 100, the training device 100 should be on a tilted axis CL. This tilted axis CL will/can vary based on the person throwing the training device 100, such as the persons height, weight, arm slot, velocity, etc. In an embodiment, to create the tilted axis CL upon leaving the hand, a thrower may keep the same existing arm slot so as not to give away what pitch is being thrown and may change only the wrist slot to position the training device 100 (or baseball) on the tilted angle, (e.g., wrist slot at a 1, 2 or 3 o'clock slot for right handed throwers and a 11, 10 or 9 o'clock slot for left handers). As discussed herein, the training device 100 provides visual feedback by its flight and spin. In an embodiment, the concept of the using a weighted training device 100 (i.e., heavier than a baseball) is when going from a heavier training device 100 to a baseball, a feeling is created in the pitcher that helps the feel of the pitch as the ball leaves the hand. Also going from a cylinder shaped training device 100 to a rounded baseball also helps create the feel of the pitch. This actually help younger players (not quite developed players) create comfort going from the cylinder to the rounded baseball/softball.

It should be appreciated that when throwing a heavier object, the difference in weight causes certain muscles/nerves to be used, for example going from the 5 oz training device 100 to the 8 oz training device 100 to the 10 oz training device 100 uses different muscles/nerves. As such, when going from a weighted training device 100 to a baseball, a feel for the pitch is created in the thrower. When going to an under-weighted training device (i.e., weighing less than a baseball, such as 3.5 oz), a faster arm speed is created in the thrower, which in turn may help in increasing the velocity of the arm speed when throwing the baseball. In an embodiment, when applying the lesson from the training device 100, when gripping a baseball, the thumb 322 and index finger 318 may create a circle on the baseball and the middle finger 316 and ring finger 306 may be placed on the baseball to be either on the two small seams or to rotate up a bit and split the seam with the ring finger 306 against the seam to help in rolling the baseball over and the pinky finger 320 located on the outside of the baseball. The baseball may be held with a loose grip to keep the baseball off of the palm. Thus, a thrower may feel the release of the baseball and create the drag off of the tips of the middle finger 316 and the ring finger 306 to allow the thrower to 'roll over the ball' with pronation. It should be appreciated that the change-up pitch is thrown with the same arm action and arm speed as the fastball pitch, but the grip itself, held loosely along with pronating the hand creates the horizontal run and the vertical drop of the 'change up' pitch.

While the invention has been described with reference to an exemplary embodiment, it should be understood by those skilled in the art that various changes may be made and equivalents may be substituted for elements thereof without departing from the scope of the invention. Moreover, the embodiments or parts of the embodiments may be combined in whole or in part without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A training device for training a baseball pitcher how to throw a predetermined pitch, the training device comprising:

a device body having a body circumference, a body length and a body diameter, wherein the device body is cylindrical in shape and includes a body side, a body first end and a body second end;

a plurality of side strips, wherein each of the plurality of side strips includes a strip depth which extends outwardly from the device body and which includes a strip width which extends along the body circumference and a strip length which extends along the body length, and wherein each of the plurality of side strips extends along the body length between the body first end and the body second end and wherein each of the plurality of side strips are equally spaced apart from each other along the body circumference, and wherein the plurality of side strips includes two opposing side strips each having a plurality of ribs which extend out of a strip surface, and which extend across the strip width, wherein each of the plurality of ribs are spaced apart from each other along the strip surface and wherein each of the plurality of ribs are spaced apart from an adjacent rib by approximately 0.75 inches and extends outwardly from the strip surface by approximately 0.03 inches; and a plurality of end strips, wherein the plurality of end strips across the body diameter on the body first end and the body second end to connect the opposing side strips and to form a cross shaped pattern on the body first end and the body second end.

2. The training device of claim 1, wherein the predetermined pitch is at least one of a change-up pitch and a fastball throw.

3. The training device of claim 1, wherein the device body defines a device body cavity for containing a weight insert.

4. The training device of claim 3, wherein the device body includes a first body portion and a second body portion, wherein the first body portion defines a first portion of the device body cavity and the second body portion defines a second portion of the device body cavity.

5. The training device of claim 4, wherein the first body portion and the second body portion are securely connected via at least one of a friction fit, a snap-fit type connector and a hook and catch type connector.

6. The training device of claim 1, wherein the training device includes a training device weight which ranges between about 3.5 ounces to about 10 ounces.

7. The training device of claim 3, wherein the training device includes a training device weight of about 5 ounces.

8. The training device of claim 1, wherein the plurality of ribs extends out from the plurality of side strips by about 0.03 inches, and wherein the plurality of ribs are spaced apart from an adjacent rib by about 0.75 inches.

9. The training device of claim 1, wherein the plurality of side strips include four (4) side strips where each of the four side strips extend out from the device body by about 0.03 inches, and wherein the plurality of side strips include a strip surface having a rougher texture than a surface of the device body, wherein the surface of the device body includes a surface roughness of between about 32 microinch per inch RMS and about 63 microinch per inch RMS and wherein the strip surface includes a surface roughness of between about 500 microinch per inch RMS and about 1000 microinch per inch RMS.

10. A training device for training a baseball pitcher how to throw a predetermined pitch, the training device comprising:

a device body having a body circumference, a body length and a body diameter, wherein the device body is cylindrical in shape and includes a body side, a body first end and a body second end;

a plurality of non-ribbed side strips, wherein each of the plurality of non-ribbed side strips includes a strip width which extends along the body circumference and a strip length which extends along the body length, wherein each of the plurality of non-ribbed side strips are disposed to be on opposing sides of the body side;

a plurality of ribbed side strips, wherein each of the plurality of ribbed side strips includes a strip width which extends along the body circumference and a strip length which extends along the body length, and wherein each of the plurality of ribbed side strips extends along the body length, wherein each of the plurality of ribbed side strips are disposed on to be on opposing sides of the body side, and wherein the plurality of ribbed side strips includes three ribs which extend outwardly from a strip surface of the plurality of ribbed side strips, and which extend across the strip width, wherein the three ribs are spaced along the strip surface to be disposed apart from each other; and a plurality of end strips, wherein the plurality of end strips extends across the body diameter on the body first end and the body second end to connect the opposing non-ribbed side strips and the opposing ribbed side strips and to form a cross shaped pattern on the body first end and the body second end.

11. The training device of claim 10, wherein the predetermined pitch is at least one of a change-up pitch and a fastball throw.

12. The training device of claim 10, wherein the device body defines a device body cavity for containing a weight insert.

13. The training device of claim 12, wherein the device body includes a first body portion and a second body portion, wherein the first body portion defines a first portion of the device body cavity and the second body portion defines a second portion of the device body cavity.

14. The training device of claim 13, wherein the first body portion and the second body portion are securely connected via at least one of a friction fit, a snap-fit type connector and a hook and catch type connector.

15. The training device of claim 10, wherein the training device includes a training device weight having a range of about 3.5 ounces to about 10 ounces.

16. The training device of claim 12, wherein the training device includes a training device weight of about 5 ounces.

17. The training device of claim 10, wherein the plurality of ribs extends out from the plurality of ribbed side strips by about 0.03 inches, and wherein the plurality of ribs are spaced apart from an adjacent rib by about 0.75 inches.

18. The training device of claim 10, wherein the plurality of non-ribbed side strips and the plurality of ribbed side strips extends out from the device body by about 0.03 inches, and wherein the plurality of non-ribbed side strips and the plurality of ribbed side strips include a strip surface having a rougher texture than a surface of the device body.

19. The training device of claim 18, wherein the plurality of ribbed side strips include a strip surface having a rougher texture than a surface of the device body, wherein the surface of the device body includes a surface roughness of between about 32 microinch per inch RMS and about 63 microinch per inch RMS and wherein the strip surface includes a surface roughness of between about 500 microinch per inch RMS and about 1000 microinch per inch RMS.

* * * * *